US011011294B2

(12) United States Patent
Sato et al.

(10) Patent No.: US 11,011,294 B2
(45) Date of Patent: May 18, 2021

(54) MULTILAYER COIL COMPONENT

(71) Applicant: TDK CORPORATION, Tokyo (JP)

(72) Inventors: Shinichi Sato, Tokyo (JP); Yohei Tadaki, Tokyo (JP); Akihiko Oide, Tokyo (JP); Yuma Ishikawa, Tokyo (JP); Hidekazu Sato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/497,314

(22) Filed: Apr. 26, 2017

(65) Prior Publication Data

US 2017/0330673 A1 Nov. 16, 2017

(30) Foreign Application Priority Data

May 11, 2016 (JP) ..... JP2016-095421

(51) Int. Cl.

| | |
|---|---|
| ***H01F 5/00*** | (2006.01) |
| ***H01F 27/245*** | (2006.01) |
| ***H01F 27/02*** | (2006.01) |
| ***H01F 17/00*** | (2006.01) |
| ***H01F 27/29*** | (2006.01) |

(Continued)

(52) U.S. Cl.

CPC ..... *H01F 27/245* (2013.01); *H01F 17/0013* (2013.01); *H01F 17/04* (2013.01); *H01F 27/022* (2013.01); *H01F 27/255* (2013.01); *H01F 27/2804* (2013.01); *H01F 27/29* (2013.01); *H01F 27/292* (2013.01); *H01F 27/323* (2013.01); *H01F 41/122* (2013.01); *H01F 41/043* (2013.01)

(58) Field of Classification Search

CPC .... H01F 1/0577; H01F 1/086; H01F 27/2804; H01F 29/16; H01F 1/0571; H01F 27/255; H01F 27/29

USPC ..... 336/200

See application file for complete search history.

(56) References Cited

U.S. PATENT DOCUMENTS 4,984,130 A * 1/1991 Dull ..... H01G 2/065 361/321.1

5,339,068 A * 8/1994 Tsunoda ..... H01C 1/02 338/308

(Continued)

FOREIGN PATENT DOCUMENTS

CN 102751092 A 10/2012

CN 103733280 A 4/2014

(Continued)

OTHER PUBLICATIONS

Jul. 2, 2018 Office Action issued in Chinese Patent Application No. 201710325242.1.

*Primary Examiner* — Alexander Talpalatski

*Assistant Examiner* — Joselito S. Baisa

(74) *Attorney, Agent, or Firm* — Oliff PLC

(57) ABSTRACT

A multilayer coil component includes an element body made of a ferrite sintered body and a coil. The coil is configured with a plurality of internal conductors juxtaposed in the element body and electrically connected to one another. An average crystal grain size in a surface region of the element body is smaller than an average crystal grain size in a region between the internal conductors in the element body. A surface of the element body is covered with a layer made of an insulating material. The insulating material is not present among the crystal grains in the surface region of the element body.

5 Claims, 8 Drawing Sheets

(51) Int. Cl.

| | |
|---|---|
| ***H01F 17/04*** | (2006.01) |
| ***H01F 27/255*** | (2006.01) |
| ***H01F 27/28*** | (2006.01) |
| ***H01F 27/32*** | (2006.01) |
| ***H01F 41/12*** | (2006.01) |
| *H01F 41/04* | (2006.01) |

(56) References Cited

U.S. PATENT DOCUMENTS 6,055,721 A * 5/2000 Mamada ..... H01F 17/045 29/605
6,535,105 B2 * 3/2003 Heistand, II ..... H01C 1/028 29/610.1
6,924,972 B2 * 8/2005 Takazawa ..... H01F 17/0013 29/25.41
7,172,806 B2 * 2/2007 Takazawa ..... H01F 17/0013 361/315
8,054,151 B2 * 11/2011 Kobayashi ..... H01F 17/04 336/83
8,284,005 B2 * 10/2012 Yamamoto ..... H01F 41/041 336/83
9,299,487 B2 * 3/2016 Naito ..... H01F 17/0013
9,378,884 B2 * 6/2016 Kim ..... H01F 17/0013
10,256,029 B2 * 4/2019 Onozaki ..... H01F 41/041
2010/0194511 A1 * 8/2010 Kobayashi ..... H01F 17/04 336/83
2010/0201473 A1 * 8/2010 Konoue ..... H01F 17/0013 336/200
2011/0267160 A1 * 11/2011 Ozeki ..... B22F 1/0074 335/302
2012/0105188 A1 * 5/2012 Lim ..... H01F 17/0033 336/200
2012/0187327 A1 * 7/2012 Ozeki ..... B22F 1/02 252/62.51 R
2012/0262840 A1 10/2012 Koizumi
2013/0033347 A1 * 2/2013 Matsuura ..... H01F 17/0013 336/83
2013/0093557 A1 4/2013 Odahara
2013/0169401 A1 * 7/2013 Lee ..... H01F 41/10 336/192
2014/0105779 A1 * 4/2014 Nakamura ..... H01F 1/0572 419/31
2014/0145816 A1 5/2014 Sato et al.
2014/0197917 A1 7/2014 Naito et al.
2014/0376152 A1 12/2014 Koizumi
2015/0028983 A1 * 1/2015 Ryu ..... H01F 1/15308 336/192
2015/0162124 A1 * 6/2015 Kim ..... H01F 17/0013 336/200
2015/0213947 A1 7/2015 Odahara
2016/0035476 A1 * 2/2016 Mimura ..... H01F 27/327 336/199
2016/0108196 A1 * 4/2016 Ward ..... C08F 2/001 428/137
2016/0126006 A1 * 5/2016 Ahn ..... H01F 27/29 336/192
2016/0314891 A1 * 10/2016 Onozaki ..... H01F 41/041

FOREIGN PATENT DOCUMENTS

JP H04-003407 A 1/1992
JP H08-097025 A 4/1996
JP 2000-058361 A 2/2000
JP 2010-040860 A 2/2010
JP 2010-080703 A 5/2013
JP 2013-089657 A 5/2013
JP 2013-183007 A 9/2013
WO 2013/024807 A1 2/2013

* cited by examiner 2
2b
3
10
17(16a)
AG PARTICLE
GLASS PARTICLE
GLASS PARTICLE 2
2b
17(16a)
AG PARTICLE 2
2b
20
17(16a)

MULTILAYER COIL COMPONENT

TECHNICAL FIELD

The present invention relates to a multilayer coil component.

BACKGROUND

Known multilayer coil components include an element body made of a ferrite sintered body and a coil (for example, see Japanese Unexamined Patent Publication No. 2010-040860). The coil is configured with a plurality of internal conductors that are juxtaposed in the element body and are electrically connected to one another.

SUMMARY

For a multilayer coil component, an element body is usually obtained by the following processes. First, green sheets each containing a ferrite material are prepared. Conductor patterns for forming internal conductors are formed on the green sheets. The green sheets in which the conductor patterns are formed and the green sheets in which no conductor patterns are formed are laminated in an intended order. Through these processes, a laminated body of green sheets is obtained. After that, the obtained laminated body of green sheets is cut into a plurality of chips of a predetermined size. The obtained chips are fired to obtain element bodies.

Regarding a multilayer coil component, a residual stress may occur in the element body due to the residual strain in ferrite crystal grains, the stress from the internal conductors, or the like. If a residual stress occurs in the element body, magnetic characteristics of the element body (for example, a magnetic permeability) are deteriorated. In order to relax the residual stress in the element body, a sintered density of the element body may be made small by decreasing a sinterability of the ferrite crystal grains, for example. If the sinterability of the element body (ferrite crystal grains) has been made low, growth of the ferrite crystal grains is suppressed, and an average crystal grain size in the element body is smaller. If the average crystal grain size in the surface region of the element body is small, the ferrite crystal grains are likely to fall off from the element body.

An object of an aspect of the present invention is to provide a multilayer coil component in which ferrite crystal grains are prevented from falling off from an element body even if a sinterability of the element body is made low.

A multilayer coil component according to one aspect of the present invention includes an element body made of a ferrite sintered body and a coil. The coil is configured with a plurality of internal conductors juxtaposed in the element body and electrically connected to one another. An average crystal grain size in a surface region of the element body is smaller than an average crystal grain size in a region between the internal conductors in the element body. A surface of the element body is covered with a layer made of an insulating material. The insulating material is not present among the crystal grains in the surface region of the element body.

In the multilayer coil component according to the one aspect, the surface of the element body is covered with the layer made of an insulating material. Therefore, even if a sinterability of the element body is made low, the ferrite crystal grains are prevented from falling off from the element body.

In the case in which an insulating material is present among crystal grains in the surface region of an element body, a stress acts on the element body from the insulating material, whereby magnetic characteristics of the element body are likely to be deteriorated. In contrast, in the multilayer coil component according to the one aspect, because the insulating material is not present among the crystal grains in the surface region of the element body, a stress from the insulating material is hardly acts on the element body. As a result, in the multilayer coil component according to the one aspect, deterioration of the magnetic characteristics of the element body is suppressed.

In a manufacturing process of a multilayer coil component, in order to increase adhesiveness of the green sheets, a high pressure is generally applied to the laminated body of green sheets in the lamination direction of the green sheets. In the regions between the conductor patterns in the laminated body of green sheets, a higher pressure acts than in the other regions. Therefore, in the above regions between the conductor patterns, the ferrite material is high in density, and sinterability is thus increased. Thus, even if the sinterability of the element body is made low, the sinterability and the sintered density are higher in the regions between the internal conductors in the element body than in the surface region of the element body. That is, the average crystal grain size in the surface region of the element body is smaller than the average crystal grain size in the regions between the internal conductors in the element body.

The average crystal grain size in the surface region of the element body may be 0.5 to 1.5 μm. In which case, the residual stress occurring in the element body is suppressed low.

A porosity on the surface of the element body may be 10 to 30%. In which case, strength of the element body is secured.

The insulating material may be glass. In which case, a thin and uniform layer is obtained.

In the layer made of an insulating material, there may be formed through holes. In which case, the through holes in the layer made of an insulating material absorb stress acting on the layer made of an insulating material. As a result, in this embodiment, damage to the layer made of an insulating material is suppressed.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION

The embodiment of the present invention will be described below in detail with reference to the accompanying drawings. In the description, identical elements or elements with identical functionality will be denoted by the same reference signs, without redundant description.

Figure 1:
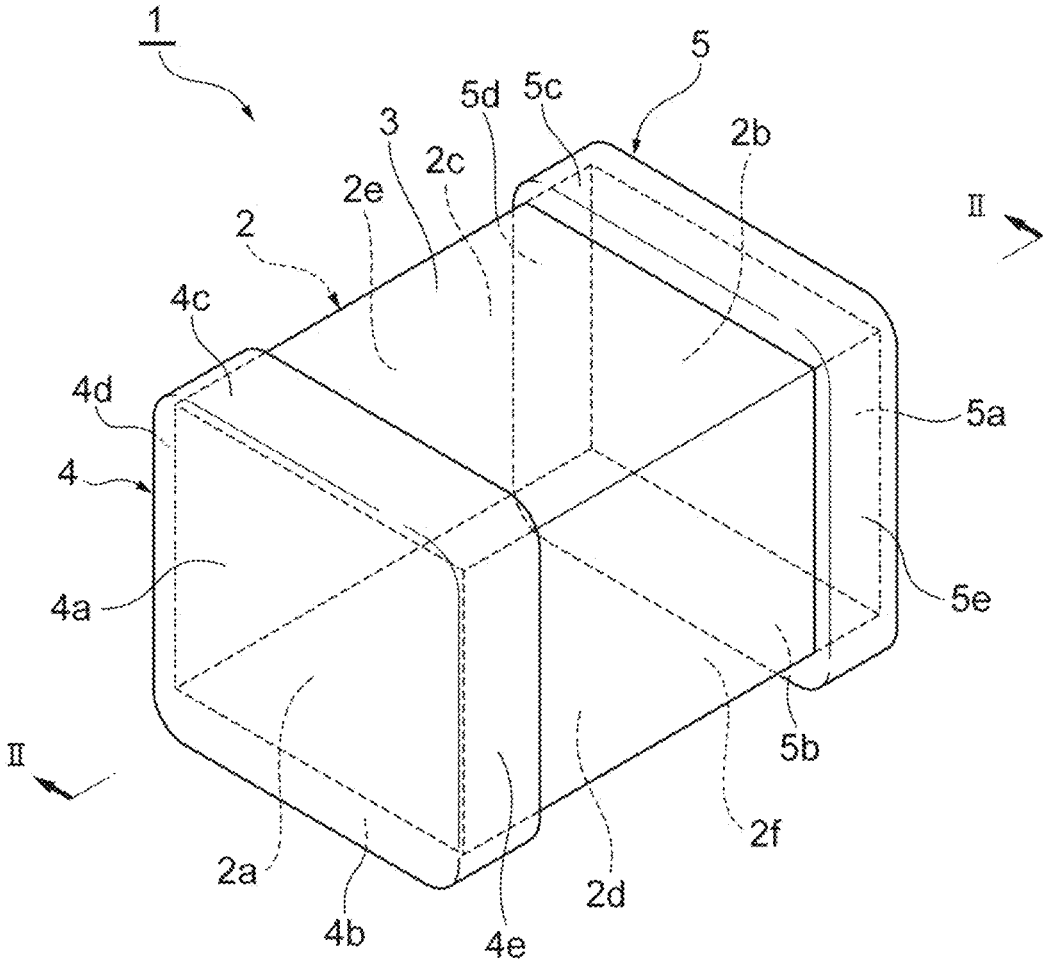
FIG. 1 is a perspective view illustrating a multilayer coil component according to an embodiment.

A multilayer coil component 1 according to the embodiment will be described with reference to FIGS. 1 to 3. FIG. 1 is a perspective view illustrating the multilayer coil component according to the embodiment. FIG. 1 is a diagram for illustrating a cross-sectional configuration along line II-II of FIG. 1. FIG. 3 is a perspective view illustrating a configuration of the coil conductors.

With reference to FIG. 1, the multilayer coil component 1 includes an element body 2 and a pair of external electrodes 4 and 5. The external electrode 4 is disposed on one end side of the element body 2. The external electrode 5 is disposed on another end side of the element body 2. The multilayer coil component 1 is applicable to a bead inductor or a power inductor, for example.

The element body 2 has a rectangular parallelepiped shape. The element body 2 includes a pair of end surfaces 2*a* and 2*b* opposing each other, a pair of principal surfaces 2*c* and 2*d* opposing each other, and a pair of side surfaces 2*e* and 2*f* opposing each other, as surfaces of the element body 2. The principal surfaces 2*c* and 2*d* extend to connect the pair of the end surfaces 2*a* and 2*b*. The side surfaces 2*e* and 2*f* extend to connect the pair of the principal surfaces 2*c* and 2*d*.

A direction in which the end surfaces 2*a* and 2*b* oppose each other, a direction in which the principal surfaces 2*c* and 2*d* oppose each other, and a direction in which the side surfaces 2*e* and 2*f* oppose each other are approximately orthogonal to each other. The rectangular parallelepiped shape includes a shape of a rectangular parallelepiped in which a corner portion and a ridge portion are chamfered and a shape of a rectangular parallelepiped in which a corner portion and a ridge portion are rounded. When the multilayer coil component 1 is mounted on an electronic device (not shown, e.g. a circuit board or an electronic component), for example, the principal surface 2*c* or the principal surface 2*d* is defined as a surface opposing the electronic device.

The element body 2 includes a plurality of insulator layers 6 (refer to FIG. 3) that are laminated. The insulator layers 6 are laminated in the direction in which the principal surfaces 2*c* and 2*d* oppose each other. A direction in which the insulator layers 6 are laminated is matched with the direction in which the principal surfaces 2*c* and 2*d* oppose each other. Hereinafter, the direction in which the principal surfaces 2*c* and 2*d* oppose each other is referred to as a "lamination direction" as well. Each insulator layer 6 has an approximately rectangular shape. In the actual element body 2, the insulator layers 6 are integrated with one another in such a manner that a boundary between the adjacent insulator layers 6 is invisible.

Each insulator layer 6 includes a sintered body of a green sheet including ferrite material (e.g. Ni—Cu—Zn based ferrite material, Ni—Cu—Zn—Mg based ferrite material, or Ni—Cu based ferrite material). The element body 2 includes a ferrite sintered body.

Figure 2:
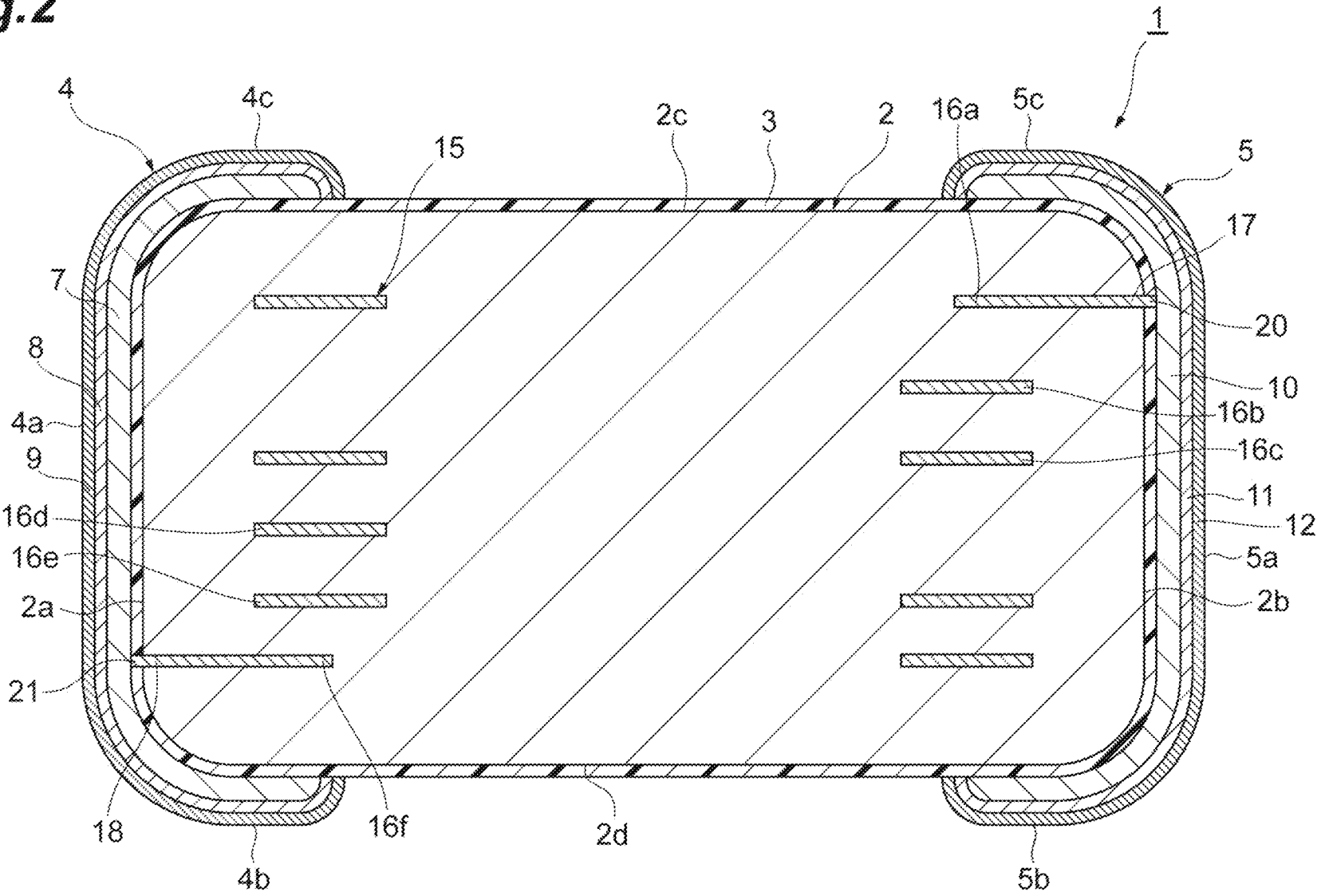
FIG. 2 is a diagram for illustrating a cross-sectional configuration along II-II line in FIG. 1.
Figure 3:
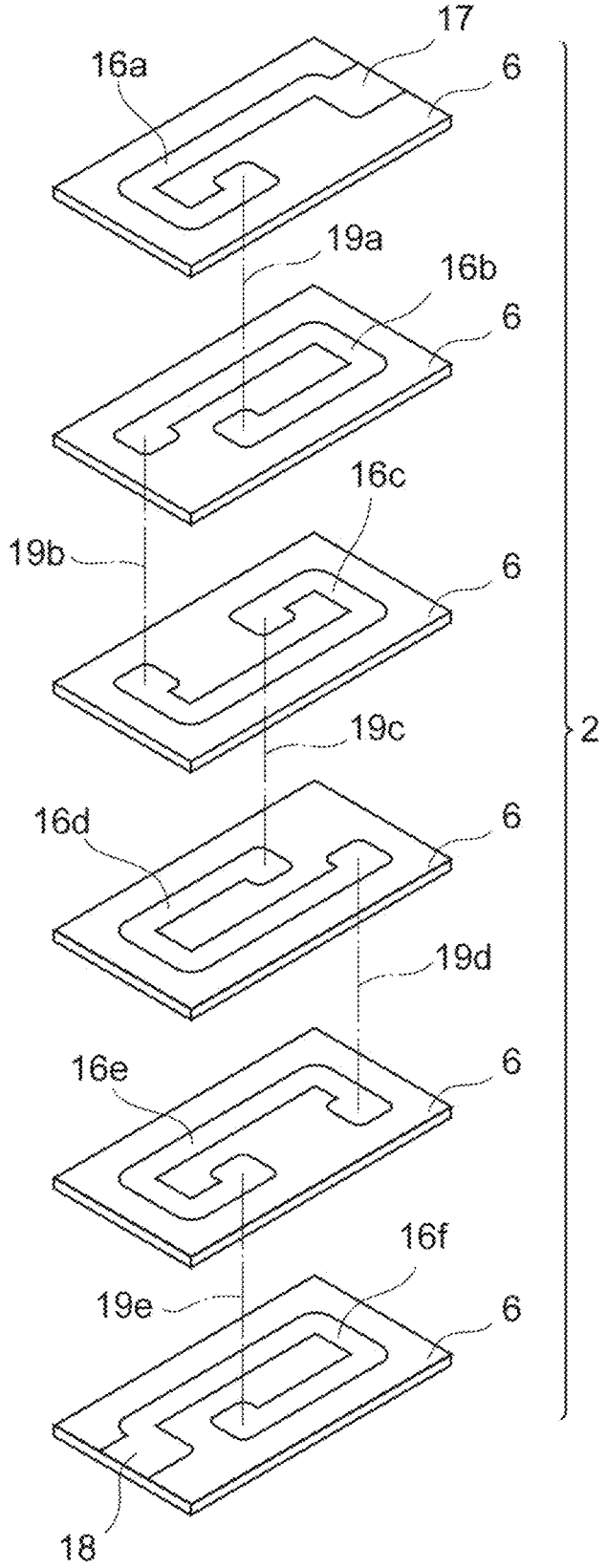
FIG. 3 is a perspective view illustrating a configuration of a coil conductor.

With reference to FIG. 2, the multilayer coil component 1 includes an insulating layer 3. The insulating layer 3 is formed on the surfaces (the end surfaces 2*a* and 2*b*, the principal surfaces 2*c* and 2*d*, and the side surfaces 2*e* and 2*f*) of the element body 2. The surfaces of the element body 2 are covered with the insulating layer 3. In the embodiment, the entire surfaces of the element body 2 are covered with the insulating layer 3. The insulating layer 3 and the element body 2 are in contact with each other. The insulating layer 3 is a layer made of an insulating material (e.g. glass). A thickness of the insulating layer 3 is 0.5 to 10 μm, for example. A softening point of glass used for the insulating layer 3 is preferably high. The softening point of glass used for the insulating layer 3 is equal to or higher than 600° C., for example. As described below, a plurality of through-holes 3*a* are formed in the insulating layer 3.

The external electrode 4 is disposed at an end surface 2*a* side of the element body 2. The external electrode 5 is disposed at an end surface 2*b* side of the element body 2. The external electrodes 4 and 5 are separated each other in the direction in which the end surfaces 2*a* and 2*b* oppose each other. The external electrodes 4 and 5 each have a substantially rectangular shape in a plane view. The external electrodes 4 and 5 have rounded corners. In the embodiment, the insulating layer 3 and each of the external electrodes 4 and 5 are in contact with each other.

The external electrode 4 includes an underlying electrode layer 7, a first plating layer 8, and a second plating layer 9. The underlying electrode layer 7, the first plating layer 8, and the second plating layer 9 are disposed in this order from the element body 2. The underlying electrode layer 7 includes a conductive material. The underlying electrode layer 7 includes a sintered body of a conductive paste including conductive metal powder and glass frit, for example. That is, the underlying electrode layer 7 is a sintered electrode layer. The conductive metal powder is Ag power, for example. The first plating layer 8 is a Ni plating layer, for example. The second plating layer 9 is a Sn plating layer, for example.

The external electrode 4 includes an electrode portion 4*a* located over the end surface 2*a*, an electrode portion 4*b* located over the principal surface 2*d*, an electrode portion 4*c* located over the principal surface 2*c*, an electrode portion 4*d* located over the side surface 2*e*, and an electrode portion 4*e* located over the side surface 2*f*. The external electrode 4 includes the five electrode portions 4*a*, 4*b*, 4*c*, 4*d*, and 4*e*. The electrode portion 4*a* covers the entire end surface 2*a*. The electrode portion 4*b* covers a part of the principal surface 2*d*. The electrode portion 4*c* covers a part of the principal surface 2*c*. The electrode portion 4*d* covers a part of the side surface 2*e*. The electrode portion 4*e* covers a part of the side surface 2*f*. The five electrode portions 4*a*, 4*b*, 4*c*, 4*d*, and 4*e* are integrally formed.

The external electrode 5 includes an underlying electrode layer 10, a first plating layer 11, and a second plating layer 12. The underlying electrode layer 10, the first plating layer 11, and the second plating layer 12 are disposed in this order from the element body 2. The underlying electrode layer 10 includes a conductive material. The underlying electrode layer 10 includes a sintered body of a conductive paste including conductive metal powder and glass frit, for example. That is, the underlying electrode layer 10 is a sintered electrode layer. The conductive metal powder is Ag power, for example. The first plating layer 11 is a Ni plating layer, for example. The second plating layer 12 is a Sn plating layer, for example.

The external electrode 5 includes an electrode portion 5*a* located over the end surface 2*b*, an electrode portion 5*b* located over the principal surface 2*d*, an electrode portion 5*c* located over the principal surface 2*c*, an electrode portion 5*d* located over the side surface 2*e*, and an electrode portion 5*e* located over the side surface 2*f*. The external electrode 5 includes the five electrode portions 5*a*, 5*b*, 5*c*, 5*d*, and 5*e*. The electrode portion 5*a* covers the entire end surface 2*b*. The electrode portion 5*b* covers a part of the principal surface 2*d*. The electrode portion 5*c* covers a part of the principal surface 2*c*. The electrode portion 5*d* covers a part of the side surface 2*e*. The electrode portion 5*e* covers a part of the side surface 2*f*. The five electrode portions 5*a*, 5*b*, 5*c*, 5*d*, and 5*e* are integrally formed.

The multilayer coil component 1 includes a coil 15 disposed in the element body 2. With reference to FIG. 3, the coil 15 includes a plurality of coil conductors (a plurality of internal conductors) 16*a*, 16*b*, 16*c*, 16*d*, 16*e*, and 16*f*.

The coil conductors 16*a* to 16*f* include a conductive material with lower electric resistance than metal (Pd) included in below-described protrusions 20 and 21. In the embodiment, the coil conductors 16*a* to 16*f* include Ag as the conductive material. The coil conductors 16*a* to 16*f* include sintered bodies of a conductive paste including the conductive material that is made of Ag.

The coil conductor 16*a* includes a connection conductor 17. The connection conductor 17 is disposed on an end surface 2*b* side of the element body 2, and electrically connects the coil conductor 16*a* to the external electrode 5. The coil conductor 16*f* includes a connection conductor 18. The connection conductor 18 is disposed on an end surface 2*a* side of the element body 2, and electrically connects the coil conductor 16*f* to the external electrode 4. The connection conductors 17 and 18 each include Ag and Pd as a conductive material. In the embodiment, the coil conductor 16*a* and the connection conductor 17 are formed to be integrally connected. The coil conductor 16*f* and the connection conductor 18 are formed to be integrally connected. In the embodiment, the coil conductor 16*a* and the connection conductor 17 are formed to be integrally connected, and the coil conductor 16*f* and the connection conductor 18 are formed to be integrally connected.

The coil conductors 16*a* to 16*f* are juxtaposed to one another inside the element body 2 in the lamination direction of the insulator layers 6. The coil conductor 16*a*, the coil conductor 16*b*, the coil conductor 16*c*, the coil conductor 16*d*, the coil conductor 16*e*, and the coil conductor 16*f* are arranged in this order from a side closest to an outermost layer.

The coil conductors 16*a* to 16*f* include respective ends that are connected to one another via through-hole conductors 19*a* to 19*e*. The coil conductors 16*a* to 16*f* are electrically connected to one another by the through-hole conductors 19*a* to 19*e*. The coil 15 includes the coil conductors 16*a* to 16*f* electrically connected to each other. The through-hole conductors 19*a* to 19*e* include Ag as a conductive material. The through-hole conductors 19*a* to 19*e* include sintered bodies of a conductive paste including the conductive material.

With reference to FIG. 2, the connection conductor 17 includes the protrusion 20. The protrusion 20 is disposed on an end surface 2*b* side of the connection conductor 17. The protrusion 20 projects from the end surface 2*b* toward the external electrode 5. The protrusion 20 passes through the insulating layer 3 and is connected to the underlying electrode layer 10 of the external electrode 5. The protrusion 20 includes metal (Pd) having a smaller diffusion coefficient than a main component of the material forming the external electrode 5 (the underlying electrode layer 10). In the embodiment, the protrusion 20 includes Ag and Pd.

The connection conductor 18 includes the protrusion 21. The protrusion 21 is disposed on an end surface 2*a* side of the connection conductor 18. The protrusion 21 projects from the end surface 2*a* of the element body 2 toward the external electrode 4. The protrusion 21 passes through the insulating layer 3 and is connected to the underlying electrode layer 7 of the external electrode 4. The protrusion 21 includes metal (Pd) having a smaller diffusion coefficient than a main component of the material forming the external electrode 4 (the underlying electrode layer 7). In the embodiment, the protrusion 21 includes Ag and Pd. Matal (Pd) included in the protrusions 20 and 21 has higher electric resistance than the coil conductors 16*a* to 16*f*.

Next, with reference to FIGS. 4A and 4B and FIGS. 7A and 7B, manufacturing processes of the multilayer coil component 1 will be described. FIGS. 4A and 4B and FIGS. 7A and 7B are diagrams each for illustrating the manufacturing process of the multilayer coil component.

Figure 4A:
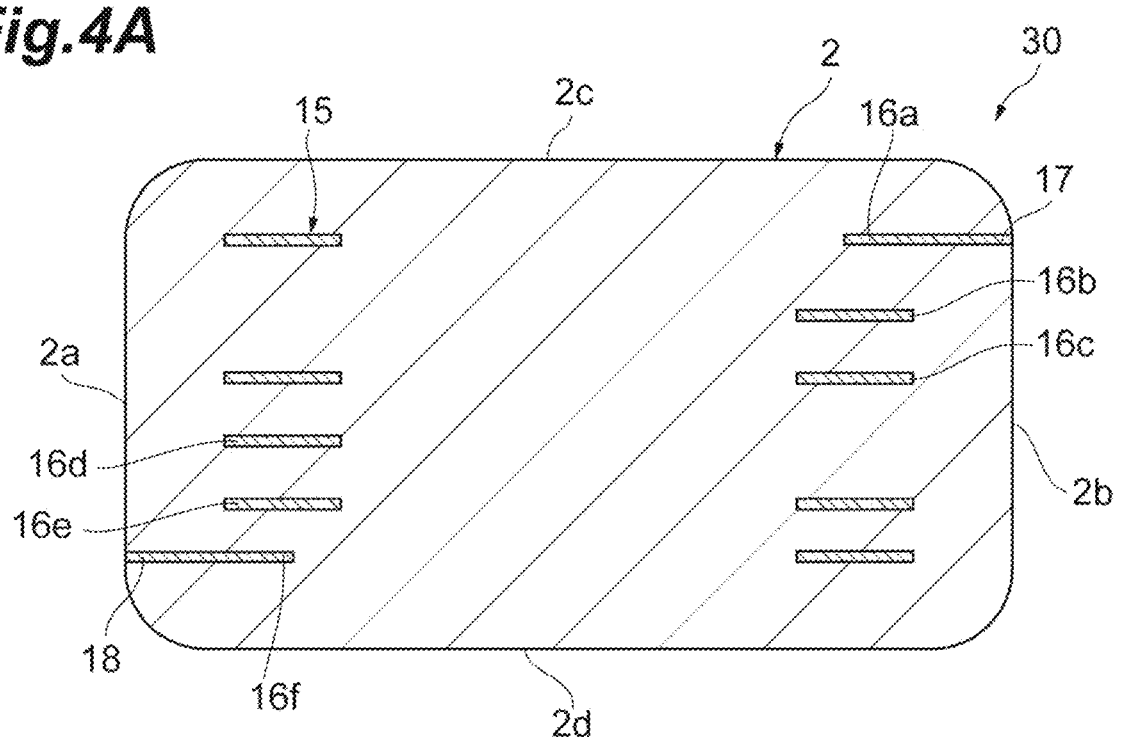
FIGS. 4A and 4B are diagrams each illustrating a manufacturing process of the multilayer coil component.

A structure 30 including the element body 2 and the coil 15 as shown in FIG. 4A is formed. In this process, green sheets (ferrite green sheets) are first prepared. The green sheets are obtained by forming ferrite slurry into sheet shapes by a doctor blade method or the like. The ferrite slurry is obtained by mixing ferrite powder, organic solvent, organic binder, plasticizer, and the like. After that, conductor patterns for forming coil conductors 16*a* to 16*f* are formed on the green sheets. The conductor patterns are formed by screen printing a conductive paste containing Ag as a metal component.

A conductor pattern for forming the connection conductor 17 is formed of a conductive paste containing Ag and Pd as metal components. A conductor pattern for forming the connection conductor 18 is formed of a conductive paste containing Ag and Pd as metal components. The conductor patterns of the connection conductor 17 and the connection conductor 18 may be formed of a conductive paste containing Ag and Pd as metal components, on the green sheets. The conductor patterns of the connection conductor 17 and the connection conductor 18 may be formed by overlaying a conductive paste containing Ag and Pd as metal components on conductor patterns formed of a conductive paste formed of Ag as a metal component.

The laminated body of green sheets is obtained by laminating, in a predetermined order, the green sheets on which the conductor patterns are formed and the green sheets on which no conductor patterns are formed. The laminated body of green sheets is subjected to a debinding process in the atmosphere and is then fired under a predetermined condition. Through these processes, the structure 30 including the element body 2 and the coil 15 is obtained.

In order to increase adhesiveness of the green sheets, a high pressure is applied to the laminated body of green sheets in the lamination direction of the green sheets. Because a higher pressure acts in the regions between the conductor patterns than in the other regions, the density of ferrite material is high in the regions between the conductor patterns, and the sinterability is thus higher. Therefore, even if the sinterability of the element body 2 is made low, the sinterability and the sintered density are higher in the regions between the coil conductors 16*a* to 16*f* in the element body 2 than in the surface region of the element body 2.

Figure 5A:
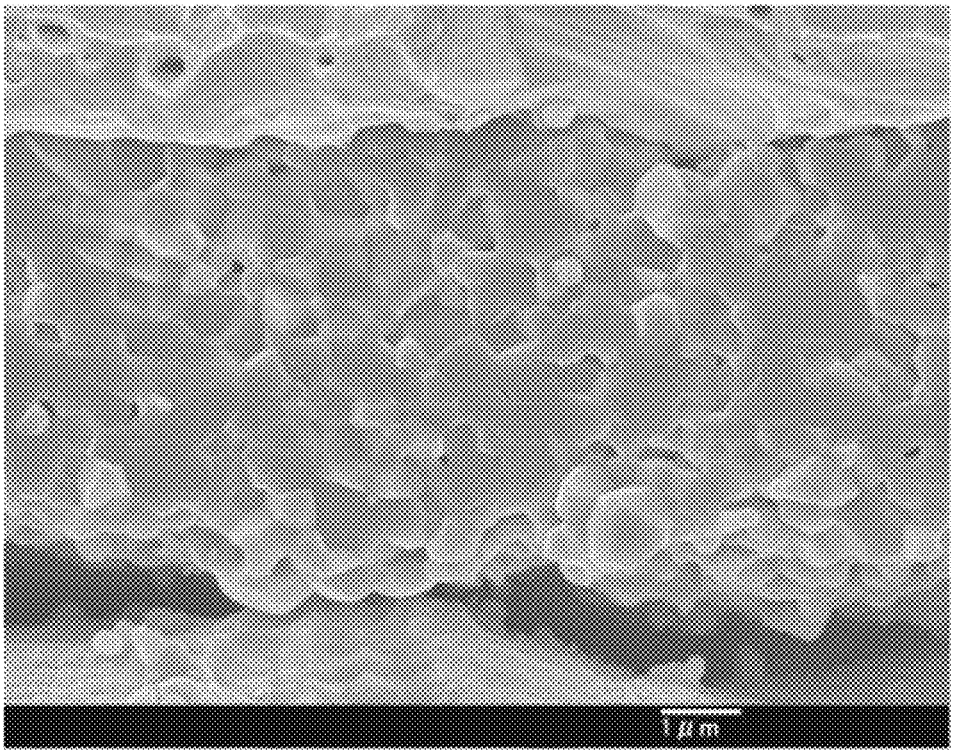
FIGS. 5A and 5B are diagrams each illustrating a SEM photograph of each of a surface region of the element body and a region between the coil conductors in the element body.
Figure 5B:
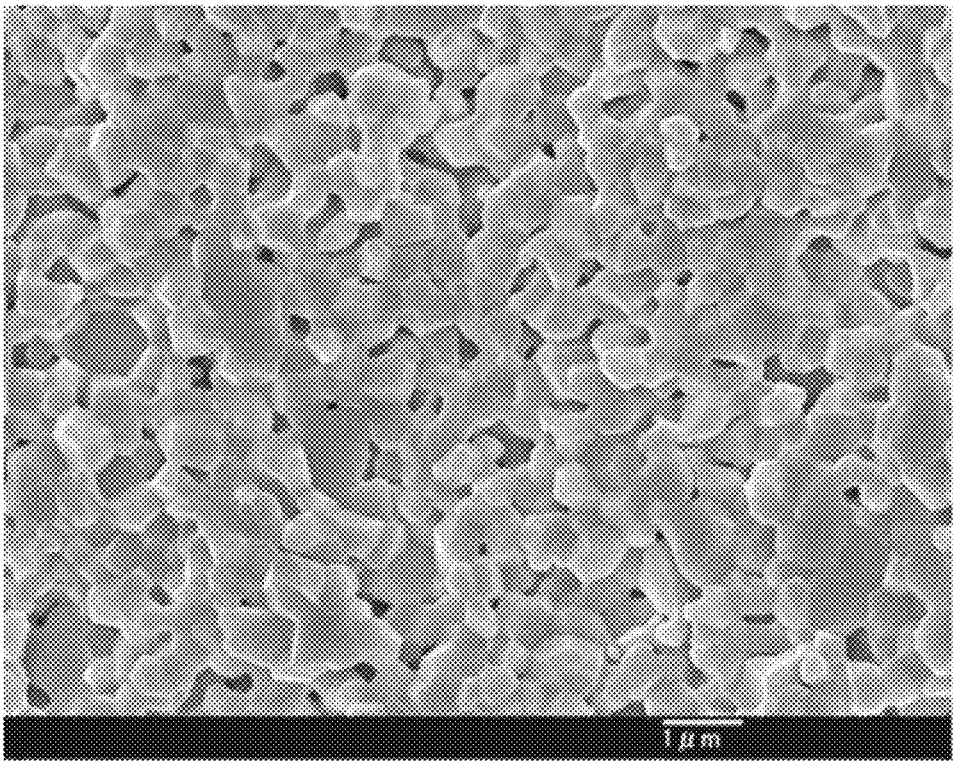

As shown in FIGS. 5A and 5B, due to the difference in a sintered density between the surface region of the element body 2 and the regions between the coil conductors 16*a* to 16*f* in the element body 2, there is a difference between the average crystal grain size of ferrite in the surface region of the element body 2 and the average crystal grain size of ferrite in the regions between the coil conductors 16*a* to 16*f* in the element body 2. The average crystal grain size of ferrite in the surface region of the element body 2 is smaller than the average crystal grain size of ferrite in the regions between the coil conductors 16*a* to 16*f* in the element body 2.

An average crystal grain size of ferrite can be obtained as described below, for example. A sample (the structure 30) is first broken, and the cross-sectional surface is ground and is further chemically etched. With respect to the etched sample, a SEM (scanning electron microscope) photograph of the surface region of the element body 2 and the regions between the coil conductors 16*a* to 16*f* in the element body 2 is taken. The SEM photograph is subjected to image processing by software, so that the boundaries between ferrite crystal grains are determined and the areas of the ferrite crystal grains are calculated. The calculated areas of the ferrite crystal grains are converted into circle-equivalent diameters, thereby obtaining the grain sizes. The average value of the obtained grain sizes of the ferrite crystal grains is the average crystal grain size.

FIG. 5A is a SEM photograph of the surface region of the element body 2. FIG. 5B is a SEM photograph of the region between the coil conductors 16*a* to 16*f* in the element body 2. The average crystal grain size of ferrite in the surface region of the element body 2 is 0.5 to 1.5 μm. The average crystal grain size of ferrite in the regions between the coil conductors 16*a* to 16*f* in the element body 2 is 2.5 to 10 μm.

A porosity in the surface of the element body 2 is 10 to 30%. The porosity can be obtained as described below, for example. A SEM photograph of the surface of a sample (the structure 30) is taken. The SEM photograph is subjected to image processing by software, so that the boundaries of voids are determined and a total value of the areas of the voids is calculated. The calculated total value is divided by the imaged area, and the thus obtained value is denoted by percentage and represents the porosity.

Figure 4B:
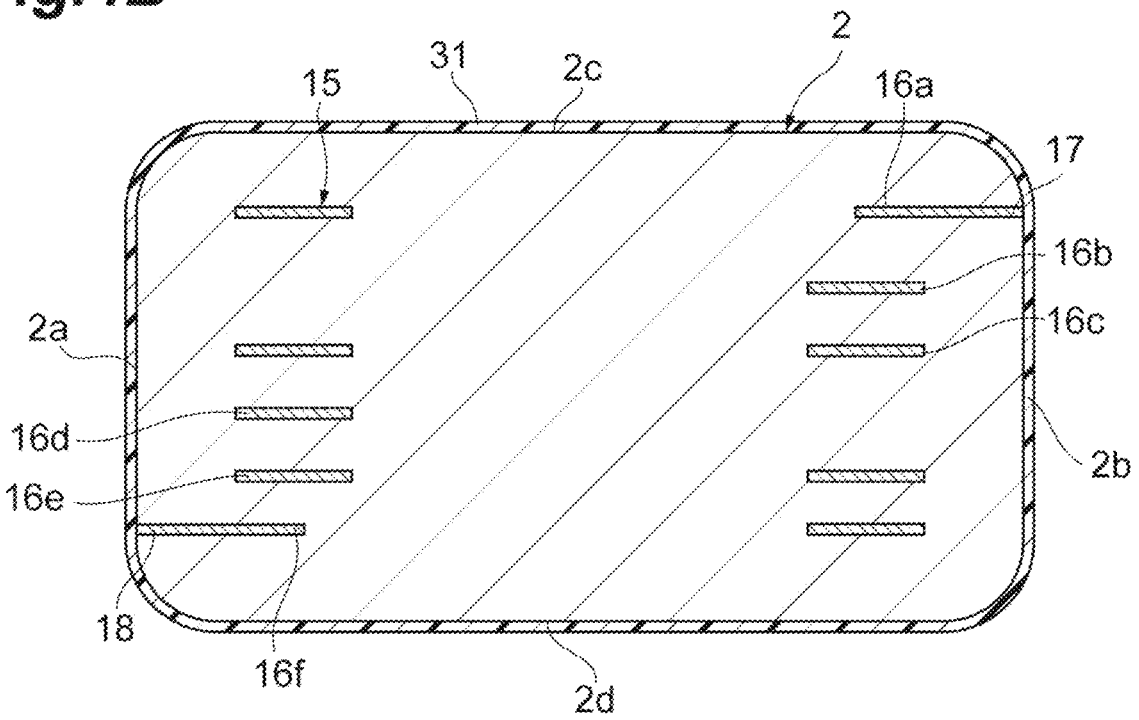

Subsequently, as shown in FIG. 4B, a film 31 for forming the insulating layer 3 is formed. In the embodiment, the film 31 is formed by applying glass slurry to the entire surface of the element body 2. The glass slurry contains glass powder, binder resin, solvent, and the like. The glass slurry is applied by a barrel spray method, for example. The insulating layer 3 is formed by simultaneously sintering the film 31 and a conductive paste for forming the underlying electrode layers 7 and 10. That is, the insulating layer 3 is formed when the underlying electrode layers 7 and 10 are sintered.

Figure 6A:
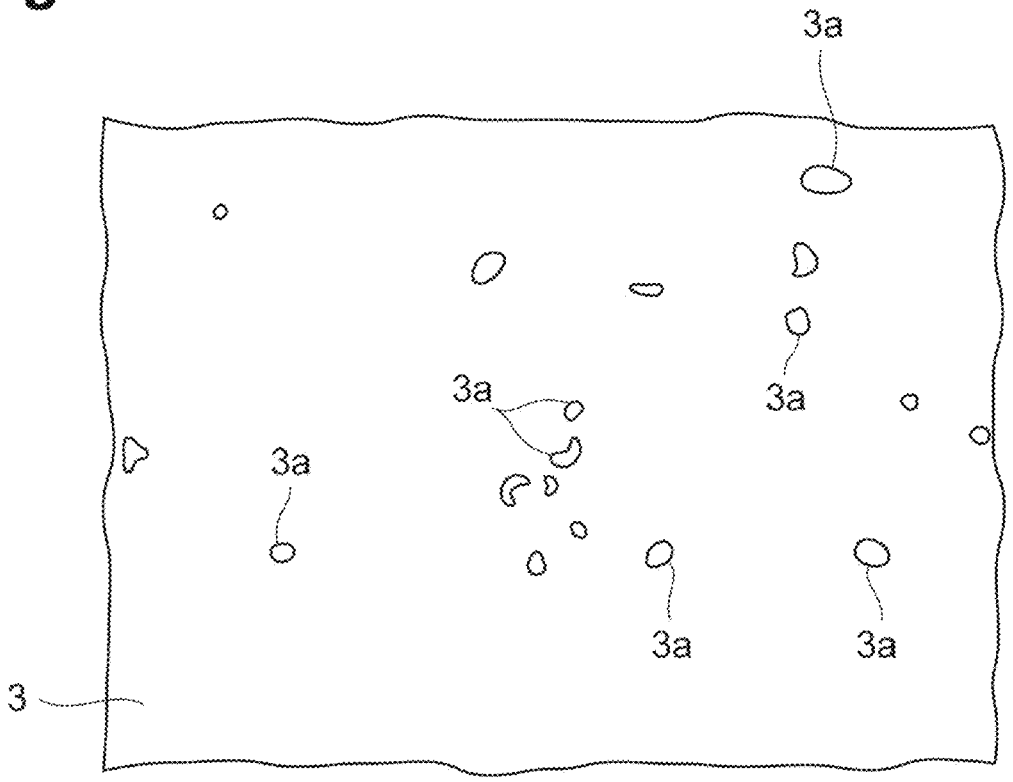
FIGS. 6A and 6B are diagrams each illustrating each of a surface of an insulating layer and a cross-sectional configuration of an insulating layer and the element body.
Figure 6B:
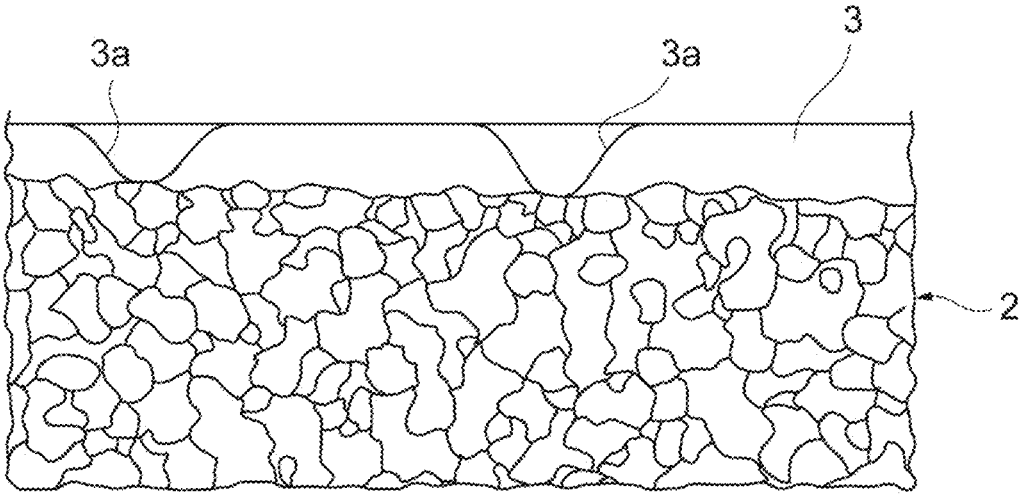

As shown in FIGS. 6A and 6B, a plurality of through holes 3*a* are formed in the insulating layer 3. The through holes 3*a* are formed in the insulating layer 3 by sintering the glass slurry when the insulating layer 3 is formed. When the glass slurry is sintered, glass shrinks and is melted, whereby a surface tension acts. Therefore, the through holes 3*a* are formed in the insulating layer 3. The diameters of the through holes 3*a* are 0.1 to 1.0 μm, for example. The number of the through holes 3*a* is 1 to 20 per 100 $\mu m^2$, for example.

FIG. 6A is a diagram illustrating the surface of the insulating layer 3. FIG. 6B is a diagram illustrating a cross-sectional configuration of the element body 2 and the insulating layer 3. In FIG. 6A, the surface of the insulating layer 3 is drawn as a diagram based on a SEM photograph of the surface of the insulating layer 3 in the multilayer coil component 1. In FIG. 6B, the cross-sectional configuration of the element body 2 and the insulating layer 3 is drawn as a diagram based on a SEM photograph of a cross-section of the multilayer coil component 1. A SEM photograph of the cross-section of the multilayer coil component 1 can be taken as described below. A sample (the multilayer coil component 1) is broken, and the cross-sectional surface is ground and is further chemically etched. With respect to the etched sample, a SEM photograph of the element body 2 and the insulating layer 3 (the surface region) is taken.

As shown in FIG. 6B, the insulating layer 3 is located on the surface of the element body 2. That is, the glass constituting the insulating layer 3 is not present among the crystal grains of ferrite in the surface region of the element body 2.

Figure 7A:
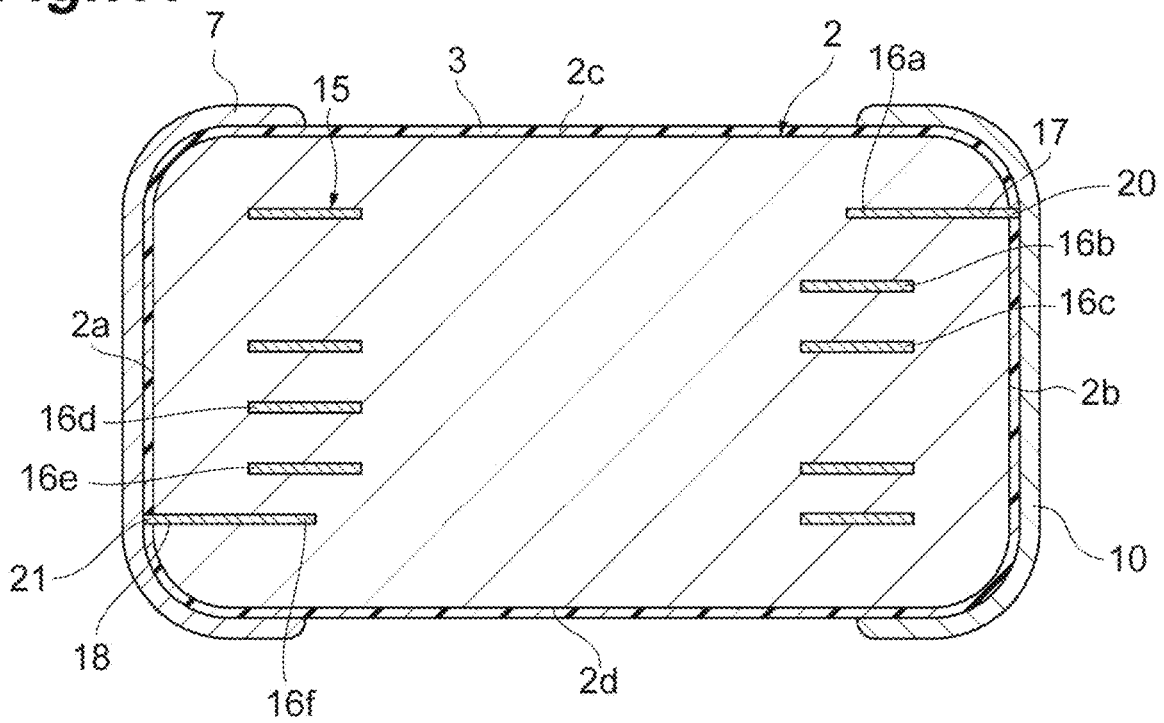
FIGS. 7A and 7B are diagrams each for illustrating a manufacturing process of the multilayer coil component.

Subsequently, as shown in FIG. 7A, the underlying electrode layers 7 and 10 are formed. The underlying electrode layers 7 and 10 are formed by applying on the film 31 a conductive paste containing Ag powder as conductive metal powder and glass frit and then sintering the applied conductive paste. A softening point of the glass frit is preferably lower than the softening point of the glass powder for forming the film 31. When the conductive paste is sintered, the connection conductors 17 and 18 are electrically connected to the underlying electrode layers 7 and 10 by the Kirkendall effect.

Figures 8A, 8B, 8C:
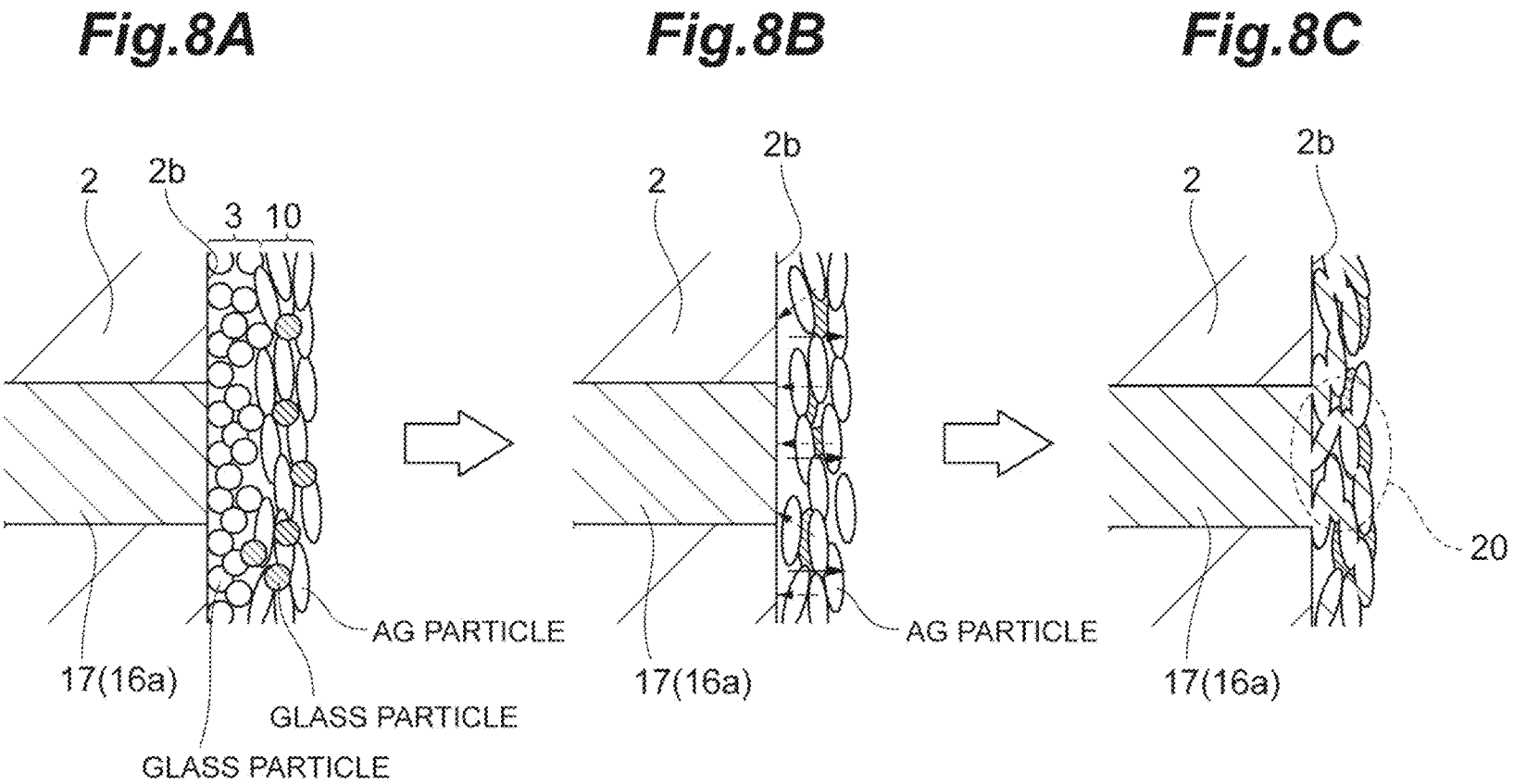
FIGS. 8A to 8C are diagrams for illustrating the manufacturing process of the multilayer coil component.

In detail, as shown in FIGS. 8A to 8C, when the conductive paste for forming the underlying electrode layers 7 and 10 is sintered, the glass particles contained in the glass slurry for the film 31 are melted and flow. Because the diffusion rate of Ag is greater than the diffusion rate of Pd, Ag particles (Ag ions) contained in the conductive paste for forming the underlying electrode layers 7 and 10 are attracted to the conductor patterns (the conductor patterns for forming the connection conductors 17 and 18) containing Pd by the Kirkendall effect. Consequently, the connection conductors 17 and 18 are extended to the sides of the underlying electrode layers 7 and 10, the connection conductors 17 and 18 are brought into contact with the underlying electrode layers 7 and 10. As a result, the connection conductors 17 and 18 are electrically connected to the underlying electrode layers 7 and 10, and the protrusions 20 and 21 penetrating the insulating layer 3 are formed.

Figure 7B:
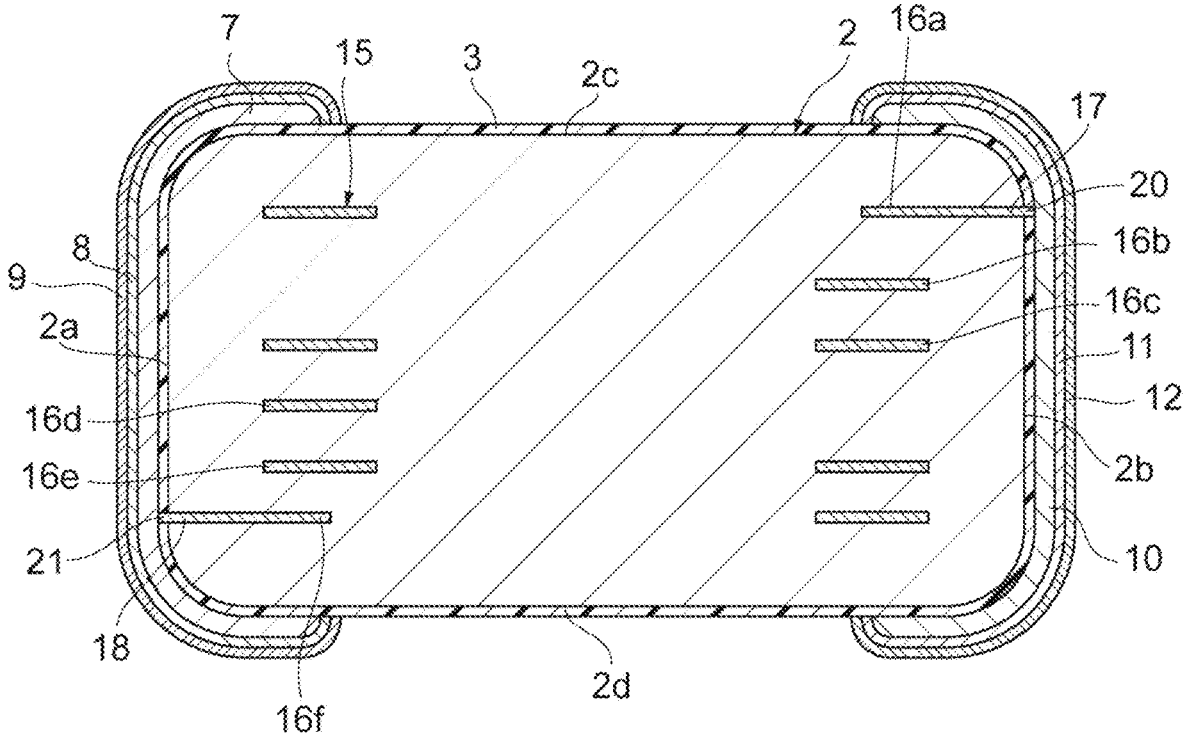

Subsequently, as shown in FIG. 7B, the first plating layers 8 and 11 and the second plating layers 9 and 12 are formed. The first plating layers 8 and 11 are Ni plating layers. The first plating layers 8 and 11 are formed by depositing Ni, using Watt's based bath by, for example, a barrel plating method. The second plating layers 9 and 12 are Sn plating layer. The second plating layers 9 and 12 are formed by depositing Sn, using a neutral tinning bath by a barrel plating method. Through the above processes, the multilayer coil component 1 is obtained.

As described above, in the embodiment, the surface of the element body 2 is covered with the insulating layer 3. Therefore, even if the sinterability of the element body 2 is made low, the ferrite crystal grains are prevented from falling off from the element body 2.

In the case in which the glass constituting the insulating layer 3 is present among the crystal grains of ferrite in the surface region of the element body 2, a stress may act from the glass on the element body 2, so that the magnetic characteristics of the element body 2 are likely to be deteriorated. In contrast, in the multilayer coil component 1, because the glass is not present among the crystal grains of ferrite in the surface region of the element body 2, a stress from the glass hardly acts on the element body 2. As a result, in the multilayer coil component 1, deterioration of the magnetic characteristics of the element body 2 is suppressed.

The average crystal grain size in the surface region of the element body 2 is 0.5 to 1.5 μm. Consequently, the residual stress occurring in the element body 2 is suppressed low.

The porosity in the surface of the element body 2 is 10 to 30%. Consequently, the strength of the element body 2 is secured. If the porosity in the surface of the element body 2 is greater than 30%, the strength of the element body 2 is lower, and, for example, if the element body 2 is subjected to impact, an external force is likely to give damage to the element body 2. If the porosity in the surface of the element body 2 is less than 10%, the residual stress occurring in the element body 2 may not be reduced.

When the insulating layer 3 is a layer made of glass, the insulating layer 3 and the underlying electrode layers 7 and 10 can be formed by the same sintering process. In which case, the manufacturing process of the multilayer coil component 1 is simplified. Further, when the insulating material constituting the insulating layer 3 is glass, the insulating layer 3 is formed thin and uniform.

The plurality of through holes 3*a* are formed in the insulating layer 3. The through holes 3*a* in the insulating layer 3 absorb the stress acting on the insulating layer 3. As a result, in the multilayer coil component 1, damage to the insulating layer 3 is suppressed.

The various embodiments have been described. However, the present invention is not limited to the embodiments and various changes, modifications, and applications can be made without departing from the gist of the present invention.

In the above embodiment, the insulating layer 3 is not limited to a layer made of glass. The insulating layer 3 may be a layer made of an insulating material other than glass, for example, a resin material such as epoxy resin. Also when the insulating layer 3 is a layer made of an insulating material other than glass, the insulating material constituting the insulating layer 3 is not present among the crystal grains of ferrite in the surface region of the element body 2.

In the embodiment described above, the external electrodes 4 and 5 include the electrode portions 4*a*, 4*b*, 4*c*, 4*d*, and 4*e*, and the electrode portions 5*a*, 5*b*, 5*c*, 5*d*, and 5*e*, respectively. The configuration of the external electrodes is not limited to this disposition. The external electrode 4 may be formed only on the end surface 2*a*, and the external electrode 5 may be formed only on the end surface 2*b*, for example. The external electrode 4 may be formed on the end surface 2*a* and at least one of the principal surfaces 2*c* and 2*d* and the side surfaces 2*e* and 2*f*, and the external electrode 5 may be formed on the end surface 2*b* and at least one of the principal surfaces 2*c* and 2*d* and the side surfaces 2*e* and 2*f*, for example.

What is claimed is:

1. A multilayer coil component comprising:

an element body made of a ferrite sintered body;

a layer made of an insulating material different from ferrite, the layer made of the insulating material covering a surface of the element body;

a through hole formed in the layer made of the insulating material;

a coil configured with a plurality of internal conductors juxtaposed in the element body and electrically connected to one another, the plurality of internal conductors being disposed in a first direction; and an external electrode electrically connected to the coil and on the layer made of the insulation material, wherein:

an average crystal grain size in a region of the surface of the element body is smaller than an average crystal grain size in a region between the internal conductors adjacent in the first direction;

the insulating material is not present among crystal grains in the region of the surface of the element body;

no portion of the plurality of internal conductors extends into the through hole;

the layer made of the insulating material includes a first region covered by the external electrode and a second region that is not covered by the external electrode; and the through hole is in the second region and is hollow.

2. The multilayer coil component according to claim 1, wherein the average crystal grain size in the region of the surface of the element body is 0.5 to 1.5 μm.

3. The multilayer coil component according to claim 1, wherein a porosity in the surface of the element body is 10 to 30%.

4. The multilayer coil component according to claim 1, wherein the insulating material is glass.

5. A multilayer coil component comprising:

a coil having a plurality of spaced internal conductors juxtaposed in a first direction and being electrically connected to one another;

an element body (1) with an outer surface, (2) in which the coil is located and (3) having an average crystal grain size in a region of the outer surface that is smaller than an average crystal grain size in a region between the plurality of the internal conductors adjacent in the first direction; and a layer made of an insulating material different from ferrite, the layer made of insulating material covering the outer surface; wherein:

the insulating material is not present among crystal grains in the region of the outer surface;

the layer of insulating material includes through holes;

no portion of the coil extends into the through holes; and the through holes are hollow in a final state of the multilayer coil component.

* * * * *